US006646528B2

(12) United States Patent
Ehrenberg et al.

(10) Patent No.: US 6,646,528 B2
(45) **Date of Patent: *Nov. 11, 2003**

(54) PROCESS FOR THE PRODUCTION OF A COIL MADE OF A HIGH TEMPERATURE SUPERCONDUCTOR MATERIAL, AND A HIGH-TEMPERATURE SUPERCONDUCTING COILS HAVING LOW AC LOSS

(75) Inventors: Juergen Ehrenberg, Huerth (DE); Joachim Bock, Erftstadt (DE); Guenter Brommer, Wiesbaden (DE)

(73) Assignee: Aventis Research & Technologies, Frankfurt am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 25 days.

(21) Appl. No.: 09/529,349

(22) PCT Filed: Oct. 1, 1998

(86) PCT No.: PCT/EP98/06262

§ 371 (c)(1),
(2), (4) Date: Jun. 30, 2000

(87) PCT Pub. No.: WO99/22386

PCT Pub. Date: May 6, 1999

(65) Prior Publication Data

US 2002/0173429 A1 Nov. 21, 2002

(30) Foreign Application Priority Data

Oct. 13, 1997 (DE) ..... 197 44 984
Sep. 11, 1998 (DE) ..... 198 41 636

(51) Int. Cl.[7] ..... H01F 1/00
(52) U.S. Cl. ..... 335/216; 505/1; 29/599
(58) Field of Search ..... 335/216, 299–302; 324/318–324; 505/1; 29/599

(56) References Cited

U.S. PATENT DOCUMENTS 4,970,483 A 11/1990 Wicker et al. ..... 335/216
5,021,398 A * 6/1991 Sharma et al. ..... 505/1
5,057,488 A * 10/1991 Arendt et al. ..... 505/1
5,112,801 A * 5/1992 Nellis et al. ..... 505/1
5,221,661 A * 6/1993 Housley ..... 505/1
5,356,868 A * 10/1994 Naito et al. ..... 505/126
5,453,494 A * 9/1995 Kirlin et al. ..... 534/15
5,531,015 A * 7/1996 Manlief et al. ..... 29/299
5,972,846 A * 10/1999 Jin et al. ..... 505/126

FOREIGN PATENT DOCUMENTS

| | | |
|---|---|---|
| DE | 3 830 092 | 3/1990 |
| EP | 0 286 410 | 10/1988 |
| EP | 0 462 409 | 12/1991 |
| JP | 5-175034 | * 1/1993 |

OTHER PUBLICATIONS

Fabbricatore et al., "Electrical Properties of Superconducting Bi–based Silver Sheathed Wires and Coils", *IEEE Transactions on Magnetics,* vol. 30 No. 4 (Jul. 1994), pp. 2332–2335.

Holesinger et al., "Isothermal Melt Processing of $Bi_2Sr_2CaCu_2O_y$ Round Wire", *Physica C,* 253 (1995) pp. 182–190. (no month).

* cited by examiner

*Primary Examiner*—Lincoln Donovan
(74) *Attorney, Agent, or Firm*—Sughrue Mion, PLLC

(57) ABSTRACT

According to the inventive method for producing a superconductive coil, a shaped body consisting of a material which is superconductive or which becomes superconductive upon subsequent heat treatment is coated with reinforcement agents and is given the geometric shape of the future coil. The invention also relates to a superconductive coil produced according to this method. Said inventive superconductive coil has low alternating current loss and consists of a highly textured superconductive material, and is oriented in such a way that the platelet levels are directly considerably in the direction of the course of the coil. The coil is formed from a superconductive solid part.

37 Claims, No Drawings

PROCESS FOR THE PRODUCTION OF A COIL MADE OF A HIGH TEMPERATURE SUPERCONDUCTOR MATERIAL, AND A HIGH-TEMPERATURE SUPERCONDUCTING COILS HAVING LOW AC LOSS

The invention relates to a process for the production of a coil made of a high-temperature superconductor material. Superconducting coils are used for the assembly of transformers for heavy currents with a strength of usually much more than 50 A, of magnets in particular for research purposes, in high-energy physics, in ore extractors, in the fabrication of semiconductor materials and for medical purposes such as e.g. magnetic resonance imaging, and for resistive current limiters.

Coils made of a high-temperature superconductor material, e.g. based on bismuth-(lead)-strontium-calcium-copper oxide (=BSCCO and PbBSCCO, respectively) or rare-earth element(s)-alkaline earth element(s)-copper oxide (=YBCO), are already known. Since, in the latter class of material, yttrium is usually, and also in the scope of the present application, counted among the rare-earth elements, since yttrium is normally regarded as the most important or only rare-earth element for this class of material, and since Ba is the most important and often only alkaline earth element (B for barium), the term "YBCO" will be used below for this class of material.

Coils which are made of wound superconducting wire now usually have a coil length of from 50 mm to 110 mm and a superconducting wire length of from 40 mm to 80 m, for example an external coil diameter of 49 mm and for example an internal coil diameter of 13 mm. As high-temperature superconductors, they are now normally prepared from a BSCCO material containing large proportions of the phases BSCCO 2212 or BSCCO 2223 with encapsulation in a silver alloy. Low-temperature superconducting coils normally contain niobium-titanium, niobium-tin or niobium-aluminum. Such coils are now normally used at the temperature of liquid helium, 4.2 K, or liquid nitrogen, 77 K, as magnets.

They can be used as high-temperature superconducting working coils in superconductor magnets together with low-temperature superconductor coils in DC operation. These magnet systems are preferably used for creating very uniform magnetic fields and are employed, in particular, in magnetic resonance imaging MRI. They are also necessary for creating strong deflecting magnetic fields in particle accelerators.

They can also be employed as AC coils in transformers, in order to be used as a secondary or primary coil, in transformers of the core or shell type, for AC voltage conversion.

Superconducting coils can also be used as resistive current limiters, in particular for AC, in order to avoid the creation of high short-circuit currents, especially in power stations, and to prevent destruction of plant components such as generators and transformers. In this case, the extraordinarily short response times are in particular advantageous.

Very few superconducting coils are now used in practice. They are wound from a high-temperature superconducting wire that has been prepared using the oxide powder in tube method (OPIT). The metal cladding usually consists of an alloy with an electrically conductive noble metal whose effect, during operation, is that some of the current carried leads to the formation of shielding currents and hence to additional electrical losses, the AC losses.

AC power loss is converted into heat, and must then be removed by the cooling system. In the superconductor material, the magnetic self-fields are also constantly changed along with the polarity reversal of the alternating current; the energy then dissipated—known as hysteresis losses—contributes substantially to the AC losses. Thin wire filaments lead in this regard to lower AC losses than large thicknesses. The AC losses are therefore substantially dependent on frequency, and on the thickness or diameter of the superconducting article or filament.

The alternating magnetic fields associated with the alternating current induce eddy currents in a conventional electrical conductor such as metallic conductors, and hence for example in silver alloys. Because of the normal-conducting properties of the metallic material, this causes resistive losses according to Ohm's law. However, the AC losses increase as the resistance of the normal conductor decreases. The AC losses in silver alloys at 20 K are therefore actually significantly higher than 77 K. Lastly, AC coupling losses can also occur in the case of closely adjoining articles, such as e.g. in a filament bundle. All three loss mechanisms increase exponentially with n=3, and therefore drastically with the current and linearly with the frequency. The values of the AC current loss are also dependent on the specimen geometry and conductor arrangement, and can therefore be compared only under standardized measurement conditions.

Attempts have been made to reduce these current losses by reducing the proportion of metal used, and optionally also fitting insulating interlayers or selecting less electrically conductive alloys. Nevertheless, the level of shielding currents is still high.

With OPIT wire, coils are usually made which, because of the wire dimensions, can only carry relatively small currents, of the order of up to about 20 A, so that very many windings are normally needed. They can be produced e.g. with high-temperature superconducting wires that have been made using the OPIT method. With the OPIT method, a tube containing predominantly silver is filled with especially fine-grained powder having the chemical composition of a superconductor which is then, e.g. by rolling, reduced in cross-section, compacted, textured, annealed and converted into the desired superconductor material, or further crystallized. These wires often have a diameter of from 0.1 to 0.3 mm including their metal cladding. They are almost always clad by a metal tube containing silver. The method is comparatively expensive and takes a very long time in all; the pure process time is normally now longer than 1 month. The coils made therefrom have the disadvantage that they are very expensive to produce and—owing to the superconductor powder quality used and the subsequent mechanical and heat treatment stages—very great performance differences occur, possibly to the extent of losing the superconducting properties at 77 K.

Because of the now often still too low current-carrying capacity and excessive AC losses of many superconductor components, their use is limited. Further development of such components is needed so that even higher currents can flow through these components superconductively and with low loss, or without loss.

When the critical current density Jc is exceeded, the superconductivity collapses and the superconductor becomes a normal conductor. This is associated with stronger heating of the conductor and possibly melting of the superconducting material.

In order to produce high-temperature superconductors with lower AC losses, or high critical current densities, it is necessary to optimize the superconducting material in terms of purity, phase purity, phase composition, degree of crystallization and orientation.

Particularly large cross sections or large widths, that is to say large thicknesses, would be advantageous because of the consequently much higher critical current density and current-carrying capacity. During production, non-superconducting foreign articles and gas inclusions in the cross section are to be avoided, since they impair the electrical properties.

High-temperature superconductor materials based on YBCO would be particularly advantageous for use in coils because of their particularly favorable values of critical current density and current-carrying capacity; but they cannot yet be drawn suitably to form wires.

U.S. Pat. No. 4,970,483 describes a YBCO coil that, inter alia, was produced by isostatic compression and sintering of a tube section and subsequent sawing, no stabilization having been used during the processing. Such coils are therefore to be handled and processed with the utmost care, with a high risk of causing irreparable damage being run.

The object was therefore to propose a process for the production of superconducting coils, with which it is possible to produce substantially or fully crack-free superconducting coils from bulk materials, and to improve the coils further in terms of their superconducting properties. These coils should preferably have no metal cladding.

The object is achieved by a process according to claim 1 and by a coil according to claims 9, 10 and 14.

A suitable starting material for the shaped article that is processed according to the invention is a shaped article made from a pre-fired, sintered or post-annealed superconducting material. It is in principle necessary to perform the process stages of pre-firing, such as e.g. calcining, sintering and optionally post-annealing, which may be carried out in a single firing operation or in several, possibly even repeated, sub-stages, in order to obtain a high-quality superconductor material. On the other hand, at the beginning of the process according to the invention it is also possible to start with an already high-quality superconducting material, which contains a high proportion of one or more superconducting phases.

The superconducting material preferably contains at least one of the superconducting phases with a composition substantially based on (Bi,Pb)—AE—Cu—O, (Y,RE)—AE—Cu—O or (TI,Pb)—(AE,Y)—Cu—O, where AE stands for alkaline earth element and, in particular, for Ba, Ca and/or Sr. In this case, the phases that occur have, in particular, a composition of approximately (Bi,Pb)2(Sr,Ca)2Cu1Ox', (Bi,Pb)2(Sr,Ca)3Cu2Ox", (Bi,Pb)2(Sr,Ca)4Cu3Ox'", (Y,RE)1Ba2Cu3Oy', (Y,RE)2Ba1Cu1Oy", (TI,Pb)2(Ba,Ca)2Cu1Oz', (TI,Pb)2(Ca,Ba)3Cu2Oz", (TI,Pb)2(Ca,Ba)4Cu3Oz'", (TI,Pb)1(Ca,Ba)3Cu2Oz"", (TI,Pb)1(Ca,Ba)4Cu3Oz"". In many cases, it is recommended that superconductor material contain, besides the superconducting phase or phases, a proportion of one or more compounds that melt only above 950° C. and do not decompose below 950° C., in particular BaSO4, SrSO4 and/or (Ba,Sr)SO4.

A superconductor material that is maximally textured and, in doing so, is maximally oriented in such a way that the platelet planes that correspond to the plane of maximum superconductivity are aligned substantially in the direction of the coil profile, is particularly preferred. This is especially advantageous when a shaped article produced using a molten casting method, in particular a centrifugal casting method, is used. Shaped articles which have been produced using a process as described in DE-A-38 30 092, EP-A-0 451 532, EP-A-0 462 409 and/or EP-A-0 477 493 are in particular suitable; because of their citation, these publications are to be regarded as fully included in the description.

A suitable starting geometry for the superconducting shaped article is a rod or a tube, a cuboid, a cuboid with very rounded edge regions or a similar geometry, above all with substantially cylindrical external geometry. Solid articles can be converted into corresponding hollow articles by mechanical processing. The shaped article should if appropriate have a maximally uniform thickness, in particular a cylindrical cavity concentric with the external surface. In principle, however, other cross sections for the shaped article and the cavity may also be used. The cavity need not be concentric with the external surface, and need not have a uniform thickness. The coil to be made usually has a cylindrical or substantially cylindrical basic shape. This coil may if appropriate present deviations in terms of shape and angle, in particular, in terms of the deviation of a cylinder from being round and deviation of the cylinder axis from a right angle with respect to the plane from which the angle of the coil pitch is calculated.

The process according to the invention is used for the production of superconducting coils or spirals from hollow articles, which may contain various superconductor materials and may have various geometries, but in particular for the production of high-temperature superconducting coils (high-Tc superconductor coils) such as e.g. based on bismuth-strontium-calcium-copper oxide. The coils may be made from tubes or similar hollow or solid articles and, at their ends, advantageously have contact surfaces that are preferably formed from silver sheets. These contacts may, however, also have burned-in metal contacts, sheet contacts based on metals other than silver, or possibly no electrically conductive contact surfaces at all.

Superconducting articles of the described type and geometry generally have a total electrical resistance <0.1 ohm, measured at room temperature, which should be checked using a 2-point measurement before actual work begins. Since tubular articles, which have been made from oxide superconductor materials, have predominantly ceramic properties, they are as a rule susceptible to cracking and fracture, in particular under prolonged mechanical processing. For this reason, it is necessary to stabilize the superconducting articles, or articles that become superconducting under further heat treatment, preferably BSCCO tubes, at least externally and optionally internally by appropriate measures. Depending on the handling involved, it may be found that in the case of articles stabilized only externally, the finished coil may have more incipient and/or microscopic cracks, which reduce the current-carrying capacity, than a coil that is also stabilized internally. It may therefore be advantageous also to use stages c) and f) of patent claim 1 during production.

To that end, external stabilization is preferably applied to the surface of the superconductor tube before making incisions or cuts to form the coil turns.

This external stabilization may be produced by wrapping the hollow article in suitable self-adhesive strips, with adhesive-impregnated organic or inorganic fabrics (e.g. layers of cotton, glass fiber mats, hemp cord), with self-curing single- or multicomponent adhesive mixtures (e.g. styrene resin, epoxy resin), with composite materials based on organic and/or inorganic adhesive and fabric components (e.g. textile fabric and plaster compound), by bonding the superconductor tube into tightly fitting metal, wood or plastic tubes, or by encapsulating the external shell of the superconductor tube with low-melting metals, metal alloys, plastics and/or inorganic binders (e.g. based on tin, Wood's metal, wax, polyethylene PE, plaster, cement). When inorganic binder systems are used, however, it should be noted that these are normally in aqueous suspension, so that, before they are used, the moisture-sensitive superconductor material is to be sealed with a layer of varnish or other waterproof coatings.

After the external stabilization has been applied to the surface of the superconductor tube, it is possible to insert a support, which is primarily used to clamp the superconductor tube in appropriate tools or machine tools (e.g. vise, lathe). It is preferably inserted into a cylindrical cavity. It is recommended to fit a support, in particular, in the case of tube diameters in excess of about 30 to 120 mm external diameter, or tube thicknesses smaller than about 5 mm, although this depends both on the raw breaking strength of the material and on the forces used and the geometry. Since this support has to withstand large forces, in particular shear forces, caused by mechanical processing operations, it should expediently consist of a thick-walled metal tube, a solid metal rod or a thick threaded metal tube. However, other materials may also be used, such as e.g. wooden rods, square wooden sections, thick-walled plastic tubes or solid plastic rods. In order to be able to discharge their task as a clamping aid, all the supports should preferably extend at least 100 mm beyond the respective end of the superconductor tube.

The superconductor tube may, for example, be connected to the support that it contains in the following way:

a) by filling the gap with self-curing single- and/or multicomponent adhesive mixtures, with low-melting metals and/or metal alloys, with plastics, wax and/or—after preparation by varnishing or similar sealing—with organic binder systems, b) by wrapping the support with self-adhesive strips and/or composite systems made of organic or inorganic fabrics, preferably combined with self-curing organic or inorganic adhesives, until a tightly fitting cylinder is created to which the superconducting tube piece can be bonded, c) by screwing-on an internally bored cylinder section made of wood, metal, alloy or plastic, which can be fitted over the support and is made to match the internal diameter of the superconducting tube, so that the latter can then be bonded on, d) by inserting a flexible cylinder section, e.g. made of soft foam plastic or expanded polystyrene, into the space between the support and the internal wall of the superconducting tube, which can then be pressed tightly into the gap to be filled, e.g. using suitable screw devices—such as e.g. a metal support designed as a threaded rod, with a circular metal plate having a diameter that is smaller than the internal diameter of the superconducting tube, and a nut on the threaded rod for pressing down the circular metal plate.

When the stabilization measures for the superconducting tube are finished, the intended thread profile with appropriate pitch can be marked on the external reinforcement or the external surface of the shaped article. The superconducting material may then be separated immediately along the intended spiral profile, e.g. by sawing, turning or milling, or, in particular in the case of small superconducting tube thicknesses, after removing the corresponding external reinforcement in the vicinity of the spiral marking, e.g. by dissolving the superconductor material in suitable acids or alkalis or—after filling the external sections and removing the internal core—by turning down the superconducting material until the externally applied filler compound becomes visible.

Since the superconducting material is susceptible to cracking and fracture, it is recommended to fill the sections that are made, preferably all-round, in order to stabilize the coil. In doing so, in addition or as an alternative, e.g. one of the following adhesive systems may be applied to the external surfaces of the superconductor material. Both the filling of the incisions/cuts and the application to the external surfaces are referred to below as external reinforcement. The application to the internal surface of the cavity is referred to as internal reinforcement. These reinforcements are expediently made e.g. by using self-curing single- or multicomponent adhesive systems which may be mixed with fine ceramic powders such as e.g. aluminum nitride, silicon nitride, aluminum oxide and/or silicon dioxide. It is, however, also possible to use purely organically based adhesive systems, such as e.g. adhesives mixed with wood dust or fine cotton or pieces of hemp, which are inserted or laid in the sections and then bonded. As an alternative, it is also possible to use inorganically based adhesive systems, such as e.g. plaster or cement mixtures, again on condition of first impregnating with a varnish or coating e.g. using plastic melts made of polyethylene PE or polyvinyl chloride PVC.

After the production of the external reinforcement has been completed, the support which the tubular coil contains is removed, together with the internal reinforcement if applicable. If indirect separation of the superconductor material by further internal turning down is intended, then the filling of any already exposed sections is superfluous. Otherwise, the section gaps are preferably filled, as already done in the case of the external sections, with appropriate materials. Optionally, the external reinforcement, which extends beyond the external diameter of the coil, and/or the internal reinforcement, which extends beyond the internal diameter of the coil, are partly or fully machined. The (remaining) external and/or internal reinforcement may optionally also be removed at the user's premises.

The external reinforcement may connect the coil turns outside the incisions/cuts between the coil turns and/or directly between the coil turns, and/or an internal reinforcement may provide mechanical strengthening. The use of a reinforcement, in the case of which the gaps between the adjacent coil turns are not filled, is favorable for better cooling. Conversely, it is favorable for mechanical stability precisely to have these gaps between the adjacent coil turns filled, since coils generally vibrate in an alternating field and are hence mechanically stressed. These gaps must, however, essentially be filled with a non-conductive material, so as not to enhance eddy currents. The finished coil must, however, be reinforced at least in the gaps, at the external diameter or at the internal diameter.

Finally, the external stabilization may, depending on its type and the requirements, be removed from the surface of the superconducting coil or spiral—i.e. on the contact surfaces for the electrical connection—and the total electrical resistance of the coil at room temperature can then be determined again using a 2-point measurement, in order to check it for damage, in particular due to incipient and/or other cracks. For stability reasons, re-application of an external reinforcement, possibly to the metallized contact areas, may then be recommended.

In order to be able to make coils with several maximally concentrically arranged windings, coils may be selected with correspondingly different internal diameters, whose windings may be kept at a sufficient distance—at least 0.1 mm, preferably at least 0.3 mm—from one another, and may be firmly connected at the ends and without interrupting the superconducting material. This can be done, for example, using a process as described in EP-A-0 442 289; because of its citation, this publication is to be regarded as fully included in the description. In this case, non-conductive or metallic reinforcements, in particular near the joins, may be advantageous for increasing mechanical stability.

As an alternative, single-, double- or multifilament coils may be produced by making incisions in a shaped article in such a way that the resulting shaped article has the geometry of a single-, double- or multifilament coil. The incisions are advantageously made along the marked spiral profile by means of mechanical separating processes such as e.g. sawing, milling, boring, turning etc., and subsequently filled with one of the adhesive combinations described above. In order to produce the double- or multifilament coil geometry, one end of the coil is preferably separated—after the separating work described above has been completed—by sawing, milling, boring, turning etc. in such a way that—after the incision of the opposite end of the coil at other points—counterrotatory spiral turns are created.

Making incisions in a shaped article for double- or multifilament coils is advantageous compared with the assembling of single-filament, or e.g. in a special case two double-filament, coils since possible quality reductions at the joins are avoided. Rectangular cross sections for the coil turns are not in principle a problem. For mechanical reasons, however, it is advantageous for the edges of the coil turns to be broken (chamfers or rounding). Because of the magnetic properties, round, maximally circular, or approximately octagonal cross sections are preferable for the coil turns, although they lead to considerable extra expense during production.

Compared with assembled single-filament coils, double- or multifilament coils machined mechanically from a single shaped article can be advantageous because, in the case of assembling, it is not possible to make the joins uniform and identical with the surrounding superconducting material.

Double-filament or multifilament coils, which have been produced by corresponding arrangement of the incisions in a shaped article or by assembling coils of different sizes, have in this case the advantage that the magnetic self-fields of the coil sections lying opposite one another can reduce each other or cancel out; inductions and eddy-current losses can be reduced further by means of this.

This is true both for double- and multifilament coils, in which at least one "single-filament" coil has a smaller internal and/or external diameter than at least one other "single-filament" coil related to it, and is true in particular for those double- and multifilament coils in which at least one coil has an external diameter that is smaller than the internal diameter of another coil related to it, and also for those double- and multifilament coils in which the coil turns of several related coils have the same, or approximately the same, internal and/or external diameter, and in which the coil turns of the various "single-filament" coils alternate regularly in the length direction of the coil. In the case of the latter type, equal internal and external diameters are preferable for manufacturing reasons.

All these spiral articles can be used as coils or in a different way as superconducting spirals. In particular, a coil according to the invention can be used as a semifinished product for the production of high-temperature superconducting transformers, windings, magnets, current limiters or electrical leads. Such coils can be used as transformer coils on the secondary side of a transformer or as current-limiting coils, and also in e.g. double-filament design, as resistive current limiters. They can also be used to amplify the magnetic field of an external magnet, in particular in the middle of the coil, as internal coils, while the outer sections of the coil can also be wound using wires, because the magnetic field which can be produced by superconducting wire windings inside the coil may not be sufficient.

In order to measure the AC loss, it is also possible to use coils with cross sections other than 5×5 mm, since the cross sections can be converted correspondingly to this.

EXAMPLES

Example 1

A high-temperature BSCCO tube with an internal diameter of 103 mm, an external diameter of 113 mm and a length of 100 mm was used to produce the high-Tc superconductor coil. There was a silver contact with a height of 20 mm on each end of the BSCCO tube. The total electrical resistance of the tube, determined using a 2-point measurement at room temperature, was 0.1 ohm. Following this resistance measurement, the external surface of the BSCCO tube was tightly wound with insulating tape of the the TESA 4651 type. The metal support was then positioned and centered in the inner part of the tube. After this, the entire interior of the tube was foamed with a mixture of isocyanate and polyether-polyol. After one hour, the remaining excess rigid polyurethane foam material was removed. A winding profile, whose pitch had been set at 7 mm, was then marked on the outer insulating tape layer. The high-Tc superconductor coil structure was then clamped in a vise. Following this, the BSCCO material of the tube was fully separated along the marked thread profile, using an iron saw containing a saw blade of the LUX-PROFI-400780 type. Following the completion of the sawing operation, the saw cuts were cleaned and filled with a mixture of styrene embedding compound of the SCANDIPLAST 9101 type and aluminum nitride powder in a ratio of 1:1. After this mixture had set, the metal rod was first withdrawn from the rigid foam core and then the rigid foam core itself was cut from the interior of the tube coil using a blade. The saw cuts, then partly exposed internally, were likewise filled with a mixture of polystyrene embedding compound and aluminum nitride powder in a ratio of 1:1. After the internal saw-cut filler had set, the outlying insulating tape was removed and the total electrical resistance was measured again at room temperature. It had a final value of 1.6 ohm. The critical current density of the coil was 476 A/cm2 at 77K.

Example 2

A BSCCO tube with the specification as in Example 1 was again used to produce the high-Tc superconductor coil. The external surface of tube was this time provided with a 5 mm thick covering of glass fiber fabric and epoxy resin. This was followed by fitting the metal support, foaming the interior of the tube, marking the thread profile, sawing the BSCCO material and filling the saw cuts with the mixture of styrene embedding compound and aluminum nitride powder, as described in Example 1. After the filling compound had set, the high-Tc superconductor spiral specimen was clamped in a lathe and the epoxy-glass fiber composite covering as well as the excess set filler compound were turned down. The metal support and the rigid foam core were then removed as described in Example 1. The final resistance measurement gave a value of 1.8 ohm.

Example 3

A BSCCO tube was again used to produce the high-Tc superconductor coil as described in Example 1. After measuring the total resistance and applying the insulating tape winding, the interior of the tube was coated with a layer of varnish. The metal support was then positioned and centered. After this, the interior of the tube was filled with a modeling plaster compound. The subsequent processing took place as described in Example 1. The set plaster compound was removed from the interior of the spiral tube using a small iron spike. The measured final resistance of the coil was 1.6 ohm. The critical current density of the coil was 548 A/cm2 at 77K.

Example 4

A BSCCO tube according to the specification described in Example 1 was again used to produce the high-Tc superconductor coil. The total resistance was measured and the tautly stretched insulating tape layer was applied to the external surface of the BSCCO tube. This was followed by the positioning of the metal support, which this time was additionally provided with a screw thread and had a diameter of 30 mm. A cylindrical soft plastic foam article was then inserted by fitting the cylinder, provided with an internal opening, by itself on the metal support and lowering it along the latter into the interior of the tube. The diameter of the internal opening of the plastic cylinder was equal to the external diameter of the metal support, while the external diameter of the cylinder was 2 mm more than the internal diameter of the BSCCO tube. In addition, the length of the soft plastic foam article was 10 mm more than the length of the superconducting tube. After the plastic cylinder had been fitted, a metal plate (material thickness=3 mm, internal bore=32 mm, external diameter=100 mm) was placed over the metal support at the end of the cylinder. The soft plastic foam article was then compressed using a nut, which was engaged on the screw thread of the metal support, so that the BSCCO tube was internally rigidified by this procedure. The processing was then continued according to Example 1. After the filling of the saw cuts had been completed, the soft foam plastic article was removed from the interior of the coil, so that the concluding work described in Example 1 could be carried out. The final value of the total electrical resistance was 1.9 ohm.

Example 5

A BSCCO tube was again used according to the specification described in Example 1. The measurement of the total resistance and the processing were likewise carried out as referred to in Example 1. In this example, however, the saw cuts were filled with a mixture of styrene embedding compound and aluminum oxide powder in a ratio of 1:1. The final resistance of the high-Tc superconductor coil was 1.8 ohm.

Example 6

According to Example 5, but with the use of a mixture of epoxy resin and aluminum nitride powder in a ratio of 1:1. The final resistance of the high-Tc superconductor coil was 1.7 ohm.

Example 7

As described in Example 1, but without silver contact surfaces on the ends of the BSCCO tube. Final resistance of the high-Tc superconductor coil 1.9 ohm.

Example 8

According to Example 1, but with the use of a BSCCO tube having an internal diameter of 55 mm, an external diameter of 70 mm and a length of 200 mm. The height of the silver contacts on the ends of the tube was 20 mm. The final resistance was 1.1 ohm after the processing.

Example 9

Production of a double-filament coil according to the basic procedure described in Example 1, and with the use of a BSCCO tube having an internal diameter of 55 mm, an external diameter of 70 mm and a length of 200 mm. In order to obtain a counterrotatory spiral thread, the singly cut spiral thread was filled with adhesive compound, and then re-divided into a second spiral thread using the saw. The required electrical leads were made using corresponding end incisions on the opposite ends of the coil. The height of the silver contacts on the respective ends of the tube was 20 mm, and the final resistance after the processing had been carried out was 1.7 ohm.

The critical current density Jc of the coils in the examples referred to above was, at 77 K: at least 100 A/cm2, preferably at least 400 A/cm2 and particularly preferably at least 500 A/cm2, at 64 K: at least 400 A/cm2, and at 4 K: at least 2000 A/cm2 or preferably at least 5000 A/cm2.

What is claim is:

1. A process for the production of a superconducting coil, comprising:

a) processing a shaped article produced using a melt cast method, if it is not provided with a cavity such that the shaped article is hollow, to form a hollow article, wherein the shaped article is made of a material which is superconducting or which becomes superconducting upon heat treatment, b) then providing the hollow article with incisions or cuts in the form of the future coil geometry, c) filling the incisions or cuts with a reinforcing material, and/or applying a reinforcing material externally to the shaped article, d) in the case of incisions, which only go partially through the article from the outside, internally machining the hollow article until the incisions become cuts, which go completely through the article from the outside to the inside, and e) partially or fully removing the reinforcement externally or internally from the hollow article.

2. The process as claimed in claim 1, wherein the superconductor material contains at least one superconducting phase with a composition having a general formula of (Bi,Pb)—AE—Cu—O, (Y,RE)—AE—Cu—O or (Tl,Pb)—(AE,Y)—Cu—O, where AE represents an alkaline earth element.

3. The process as claimed in claim 1, wherein the superconductor material contains, besides at least one superconducting phase, a proportion of one or more compounds that melt only above 950° C. and do not decompose below 950° C.

4. The process as claimed in claim 1, wherein electrical connection surfaces have any reinforcing material removed and are coated or covered with a metallic, electrically conductive material.

5. The process as claimed in claim 1, wherein a textured article is shaped in the current direction through the coil.

6. The process as claimed in claim 1, further comprising forming the shaped article by centrifugal casting, wherein the article becomes superconducting after further heat treatment.

7. The process as claimed in claim 1, wherein the incisions are made in the shaped article so that the resulting shaped article is a single-, double- or multifilament coil.

8. The process as claimed in claim 1, further comprising placing at least two superconducting coils with different diameters one inside the other and assembling the coils to form a double- or multifilament coil.

9. A superconducting coil produced using a process as claimed in claim 1.

10. A superconducting coil made of a superconductor material that is strongly textured and is oriented in such a way that platelet planes that correspond to a plane of maximum superconductivity are aligned in the direction of a coil profile, the coil being machined from a bulk superconducting piece which is produced using a molten cast method.

11. The superconducting coil as claimed in claim 10, wherein the superconductor material contains at least one superconducting phase with a composition having a general formula of (Bi,Pb)—AE—Cu—O, (Y,RE)—AE—Cu—O or (Tl,Pb)—(AE,Y)—Cu—O, where AE represents an alkaline earth element.

12. The superconducting coil as claimed in claim 10, wherein the superconductor material contains, besides at least one superconducting phase, a proportion of one or more compounds that melt only above 950° C. and do not decompose below 950° C.

13. The superconducting coil as claimed in claim 10, further comprising forming a shaped article for the superconducting coil by centrifugal casting and machining the superconducting coil from the shaped article.

14. A superconducting coil having low AC loss comprising windings or filaments, with a distance from one winding to a next winding, or from one filament to a next filament, of at least 0.15 mm, said superconducting coil being produced by machining a shaped article produced by using a melt cast method.

15. The superconducting coil as claimed in claim 14, wherein the coil has contact surfaces, and the contact surfaces of the coil are coated with a metallic, electrically conductive material, or are covered with a foil or a sheet of this material.

16. The superconducting coil as claimed in claim 14, which does not have any full-surface metallic cladding or covering.

17. The superconducting coil as claimed in claim 14, wherein at least a central region of the coil is free of any metallic or other electrically normal-conducting cladding or covering.

18. The superconducting coil as claimed in claim 14, wherein the coil has incisions and has an external reinforcement of the coil windings, which reinforces the coil windings outside the incisions and/or between the coil windings.

19. A superconducting coil assembly comprising a superconducting coil as claimed in claim 14 and an external reinforcement, wherein the coil has incisions, wherein the external reinforcement reinforces coil windings, and wherein the external reinforcement contains an organic or inorganic adhesive system or a multicomponent adhesive system.

20. A method of using a superconducting coil, comprising forming a semifinished product from a superconducting coil as claimed in claim 10 for the production of high-temperature superconducting transformers, windings, magnets, inner coils of magnets, current limiters or electrical leads.

21. A method of using a superconducting coil, comprising forming a semifinished product from a superconducting coil as claimed in claim 9 for the production of high-temperature superconducting transformers, windings, magnets, inner coils of magnets, current limiters or electrical leads.

22. A method of using a superconducting coil, comprising forming a semifinished product from a superconducting coil as claimed in claim 14 for the production of high-temperature superconducting transformers, windings, magnets, inner coils of magnets, current limiters or electrical leads.

23. The process as claimed in claim 1, further comprising coating the shaped article externally with a reinforcement.

24. The process as claimed in claim 1, further comprising connecting the hollow article internally to a support acting as an internal reinforcement.

25. The process as claimed in claim 23, further comprising connecting the externally reinforced hollow article internally to a support acting as an internal reinforcement.

26. The process as claimed in claim 24, further comprising removing the support acting as an internal reinforcement from the interior of the hollow article.

27. The process as claimed in claim 25, further comprising removing the support acting as an internal reinforcement from the interior of the hollow article.

28. The process as claimed in claim 1, further comprising coating the hollow article on the inside with a reinforcing material.

29. The process as claimed in claim 1, wherein the hollow article is provided with cuts, and wherein the process further comprises filling the cuts with a reinforcing material.

30. The process as claimed in claim 29, further comprising retaining the filling of the cuts.

31. The process as claimed in claim 29, further comprising filling the cuts with a reinforcing material from the outside.

32. The process as claimed in claim 2, wherein the alkaline earth element is Ba, Ca and/or Sr.

33. The process as claimed in claim 3, wherein the one or more compounds that melt only above 950° C. and do not decompose below 950° C. are BaSO4, SrSO4 and/or (Ba, Sr)SO4.

34. The process as claimed in claim 4, wherein the metallic, electrically conductive material is a silver alloy.

35. The process as claimed in claim 11, wherein the alkaline earth element is Ba, Ca and/or Sr.

36. The process as claimed in claim 12, wherein the one or more compounds that melt only above 950° C. and do not decompose below 950° C. are BaSO4, SrSO4 and/or (Ba, Sr)SO4.

37. The superconducting coil assembly as claimed in claim 19, wherein the external reinforcement is reinforced with an aluminum nitride, silicon nitride, aluminum oxide and/or silicon dioxide filler.

* * * * *